US011037751B2

(12) United States Patent
Ishihara

(10) Patent No.: US 11,037,751 B2
(45) Date of Patent: Jun. 15, 2021

(54) X-RAY TUBE

(71) Applicant: CANON ELECTRON TUBES & DEVICES CO., LTD., Otawara (JP)

(72) Inventor: Tomonari Ishihara, Otawara (JP)

(73) Assignee: CANON ELECTRON TUBES & DEVICES CO., LTD., Otawara (JP)

( * ) Notice: Subject to any disclaimer, the term of this patent is extended or adjusted under 35 U.S.C. 154(b) by 160 days.

(21) Appl. No.: 16/372,609

(22) Filed: Apr. 2, 2019

(65) Prior Publication Data

US 2019/0228941 A1 Jul. 25, 2019

Related U.S. Application Data

(63) Continuation of application No. PCT/JP2017/020312, filed on May 31, 2017.

(30) Foreign Application Priority Data

Oct. 3, 2016 (JP) ..... JP2016-195589

(51) Int. Cl.
*H01J 35/06* (2006.01)
*H01J 35/10* (2006.01)

(52) U.S. Cl.
CPC ..... *H01J 35/065* (2013.01); *H01J 35/06* (2013.01); *H01J 35/066* (2019.05); *H01J 35/101* (2013.01)

(58) Field of Classification Search
USPC ..... 378/134
See application file for complete search history.

(56) References Cited

U.S. PATENT DOCUMENTS

2004/0081282 A1* 4/2004 Schaefer ..... H01J 35/06 378/136
2015/0117617 A1 4/2015 Ishihara et al.

FOREIGN PATENT DOCUMENTS

| | | | |
|---|---|---|---|
| CN | 104246964 | A | 12/2014 |
| CN | 104428865 | A | 3/2015 |
| EP | 2 869 327 | A1 | 5/2015 |
| JP | 2-207443 | | 8/1990 |
| JP | 2-128356 | U | 10/1990 |
| JP | 4-87299 | | 3/1992 |
| JP | 11-273598 | | 10/1999 |
| JP | 2005-56843 | | 3/2005 |

(Continued)

OTHER PUBLICATIONS

International Search Report dated Aug. 15, 2017 in PCT/JP2017/020312, filed on May 31, 2017 (with English Translation).

(Continued)

*Primary Examiner* — Hoon K Song
(74) *Attorney, Agent, or Firm* — Oblon, McClelland, Maier & Neustadt, L.L.P.

(57) ABSTRACT

According to one embodiment, an X-ray tube includes an anode target, a cathode including a first filament and a converging electrode, and a vacuum envelope. The converging electrode includes a flat front surface, a flat first surface, a first groove portion, and a pair of first protruding portions. The pair of first protruding portions is formed to protrude from the first surface toward the front surface and sandwich the first groove portion in a first length direction. An upper surface is formed of a plurality of flat inclined surfaces.

8 Claims, 10 Drawing Sheets

(56) References Cited

FOREIGN PATENT DOCUMENTS

| | | |
|---|---|---|
| JP | 2009-158138 | 7/2009 |
| WO | WO 2014/007167 A1 | 1/2014 |

OTHER PUBLICATIONS

Written Opinion dated Aug. 15, 2017 in PCT/JP2017/020312, filed on May 31, 2017.
Extended European Search Report dated Mar. 23, 2020, in Patent Application No. 17858010.6, 8 pages.
Combined Chinese Office Action and Search Report dated Jul. 24, 2020 in corresponding Chinese Patent Application No. 201780061262.0 (with English Translation), 16 pages.

* cited by examiner

X-RAY TUBE

CROSS-REFERENCE TO RELATED APPLICATIONS

This application is a Continuation Application of PCT Application No. PCT/JP2017/020312, filed May 31, 2017 and based upon and claiming the benefit of priority from Japanese Patent Application No. 2016-195589, filed Oct. 3, 2016, the entire contents of all of which are incorporated herein by reference.

FIELD

Embodiments described herein relate generally to an X-ray tube.

BACKGROUND

X-ray tubes are used for X-ray image diagnosis, non-destructive inspection, and the like. Examples of the X-ray tubes include a stationary anode type X-ray tube and a rotation anode type X-ray tube, and the X-ray tube is used according to its use. An X-ray tube comprises an anode target, a cathode, and a vacuum envelope. On the anode target, a focal spot on which an electron beam is made incident to emit X-rays is formed.

The cathode comprises a filament coil and an electron convergence cup. The filament coil can emit electrons. A high tube voltage in the range of several tens to one hundred and several tens of kilovolts (kV) is applied between the anode target and the cathode. For this reason, the electron convergence cup can play a role of an electron lens, i.e., can urge an electron beam traveling toward the anode target to be converged. The rotation anode X-ray tube is generally used for medical diagnosis. In general, the X-ray tube has two focal spots, i.e., a large focal spot having large dimensions and enabling a large current to be input, and a small focal spot having small dimensions, and a small input but a high resolution. One of X-ray tubes has three focal spots. Dimensions of each focal spot depend on each of the shape and positional relationship of the filament coil and the electron converging cup and are fixed in general. When a large focal spot or a small focal spot is used, imaging conditions are determined by determining a spatial resolution and an input current (influenced by contrast and noise) in accordance with application of diagnosis, and the large focal spot and the small focal spot are used separately.

With only two focal spots, however, imaging conditions are discontinuous and images necessary for x-ray image diagnosis can hardly be obtained in some cases. In particular, when imaging is performed continuously in an axial direction of a subject in a manner such as helical scanning in an X-ray CT device, continuity in image quality cannot be maintained and accurate image diagnosis cannot be performed due to variation in input at two focal spots that are discontinuous, in some cases. Thus, a method of varying dimensions of the focal spot by varying voltages of a plurality of electrodes in accordance with electric signals has been provided.

In such a focal spot dimension varying method, however, the control and the structure are complicated or complicated control to adjust a ratio between a tube current and dimensions of a focal spot is required. In addition, a tube current which can be input is limited due to the dimensions of the focal spot but, if the control of the current and that of the dimensions of the focal spot are exerted by different systems, there is a possibility that if those controls are in nonconformity to each other an overcurrent will be caused, resulting in breakage of an X-ray tube.

Furthermore, when the dimensions of the focal spot are varied, the focal spot can hardly be controlled to be set to desired dimensions. For example, variations in length and width of the focal spot are greatly different with respect to a variation in a bias voltage applied to an electron convergence cup. For this reason, the ratio of the dimensions of the focal spot and the amount of current can hardly be adjusted to appropriate values at the same time. Thus, a technique of preparing an electrode which controls the length of the focal spot and an electrode which controls the width of the focal spot and controlling the focal spot to have desired dimensions has been proposed.

DETAILED DESCRIPTION

Figure 1:
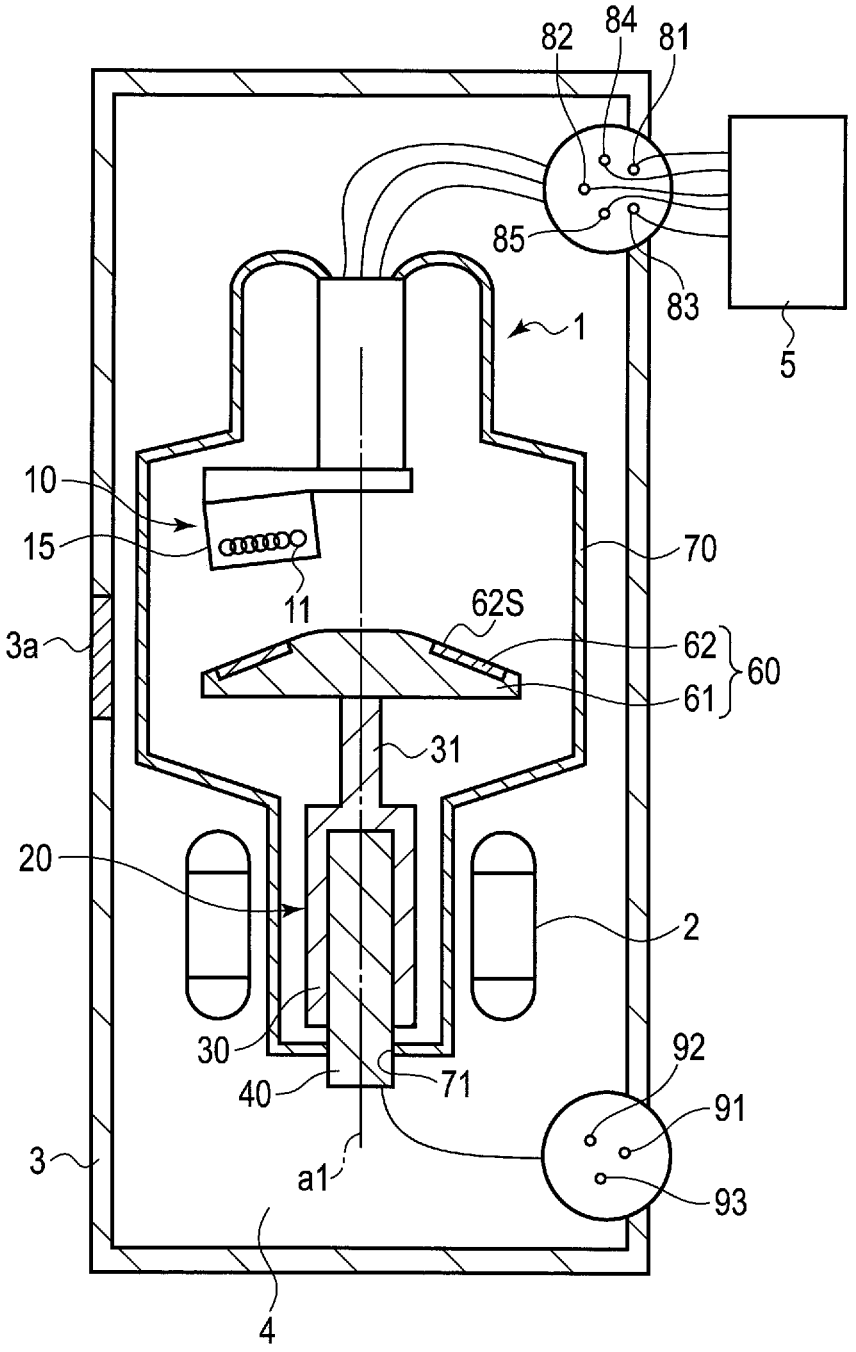
FIG. 1 is a cross-sectional view showing an X-ray tube assembly according to one of embodiments.

In general, according to one embodiment, there is provided an X-ray tube comprising: an anode target emitting X-rays by electrons made incident thereon; a cathode comprising a first filament emitting electrons and a converging electrode urging the electrons emitted from the first filament to be converged; and a vacuum envelope accommodating the anode target and the cathode. The converging electrode comprises a flat front surface which is the closest to the anode target, a flat first surface located on a side opposite to the anode target with respect to the front surface, a first trench portion opening to the first surface, accommodating the first filament, and having a first length direction along a longer axis of the first filament, and a pair of first protruding portions formed to protrude from the first surface toward the front surface side and sandwiching the first trench portion in the first length direction, and an upper surface of each of the first protruding portions on a side opposed to the anode target is formed of a plurality of flat inclined surfaces inclined in directions different from one another.

One of embodiments will be described hereinafter with reference to the accompanying drawings. The disclosure is merely an example, and proper changes in keeping with the spirit of the invention, which are easily conceivable by a person of ordinary skill in the art, come within the scope of the invention as a matter of course. In addition, in some cases, in order to make the description clearer, the widths, thicknesses, shapes, and the like, of the respective parts are illustrated schematically in the drawings, rather than as an accurate representation of what is implemented. However, such schematic illustration is merely exemplary, and in no way restricts the interpretation of the invention. In addition, in the specification and drawings, the same elements as those described in connection with preceding drawings are denoted by like reference numbers, and detailed description thereof is omitted unless necessary.

FIG. 1 is a cross-sectional view showing an X-ray tube assembly according to one of embodiments. In the embodiment, the X-ray tube assembly is a rotation anode X-ray tube assembly.

As shown in FIG. 1, the X-ray tube assembly comprises a rotation anode X-ray tube 1, a stator coil 2 serving as a coil which generates a magnetic field, a housing 3 which accommodates the X-ray tube and the stator coil, an insulating oil 4 serving as a coolant filled in the housing, and a controller 5.

The X-ray tube 1 comprises a cathode (cathode electron gun) 10, a sliding bearing unit 20, an anode target 60, and a vacuum envelope 70.

The sliding bearing unit 20 comprises a rotor 30, a fixed shaft 40 serving as a fixed body, and a metallic lubricant (not shown) serving as a lubricant, and uses sliding bearings.

The rotor 30 is formed in a cylindrical shape, and one end portion of the rotor 30 is closed. The rotor 30 extends along the axis of rotation, which is a central axis of a rotating operation of the rotor. In the embodiment, the axis of rotation is the same as a tube axis a1 of the X-ray tube 1, and will be hereinafter explained as the tube axis a1. The rotor 30 can be rotated about the tube axis a1. The rotor 30 includes a connection portion 31 located at this end portion. The rotor 30 is formed of a material such as iron (Fe) or molybdenum (Mo).

The fixed shaft 40 is formed in a cylindrical shape having dimensions smaller than those of the rotor 30. The fixed shaft 40 is provided coaxially with the rotor 30 and extends along the tube axis a1. The fixed shaft 40 is fitted in an inner part of the rotor 30. The fixed shaft 40 is formed of a material such as Fe or Mo. One end portion of the fixed shaft 40 is exposed to the outside of the rotor 30. The fixed shaft 40 supports the rotor 30 in such a manner as to permit the rotor 30 to be rotated.

The metallic lubricant is filled in a gap between the rotor 30 and the fixed shaft 40.

The anode target 60 is located opposite to the other end portion of the fixed shaft 40 in a direction along the tube axis a1. The anode target 60 includes an anode body 61 and a target layer 62 provided on part of an outer surface of the anode body.

The anode body 61 is fixed to the rotor 30 by means of the connection portion 31. The anode body 61 has a disk-like shape and is formed of a material such as Mo. The anode body 61 is rotatable around the tube axis a1. The target layer 62 is formed in an annular shape. The target layer 62 includes a target surface 62S which is opposed to and spaced apart from the cathode 10 in the direction along the tube axis a1. In the anode target 60, an electron beam is made incident on the target surface 62S, and a focal spot is thereby formed on the target surface 62S and X-rays are emitted from the focal spot.

The anode target 60 is electrically connected to a terminal 91 via the rotor 30, the fixed shaft 40, and the like.

Figure 2:
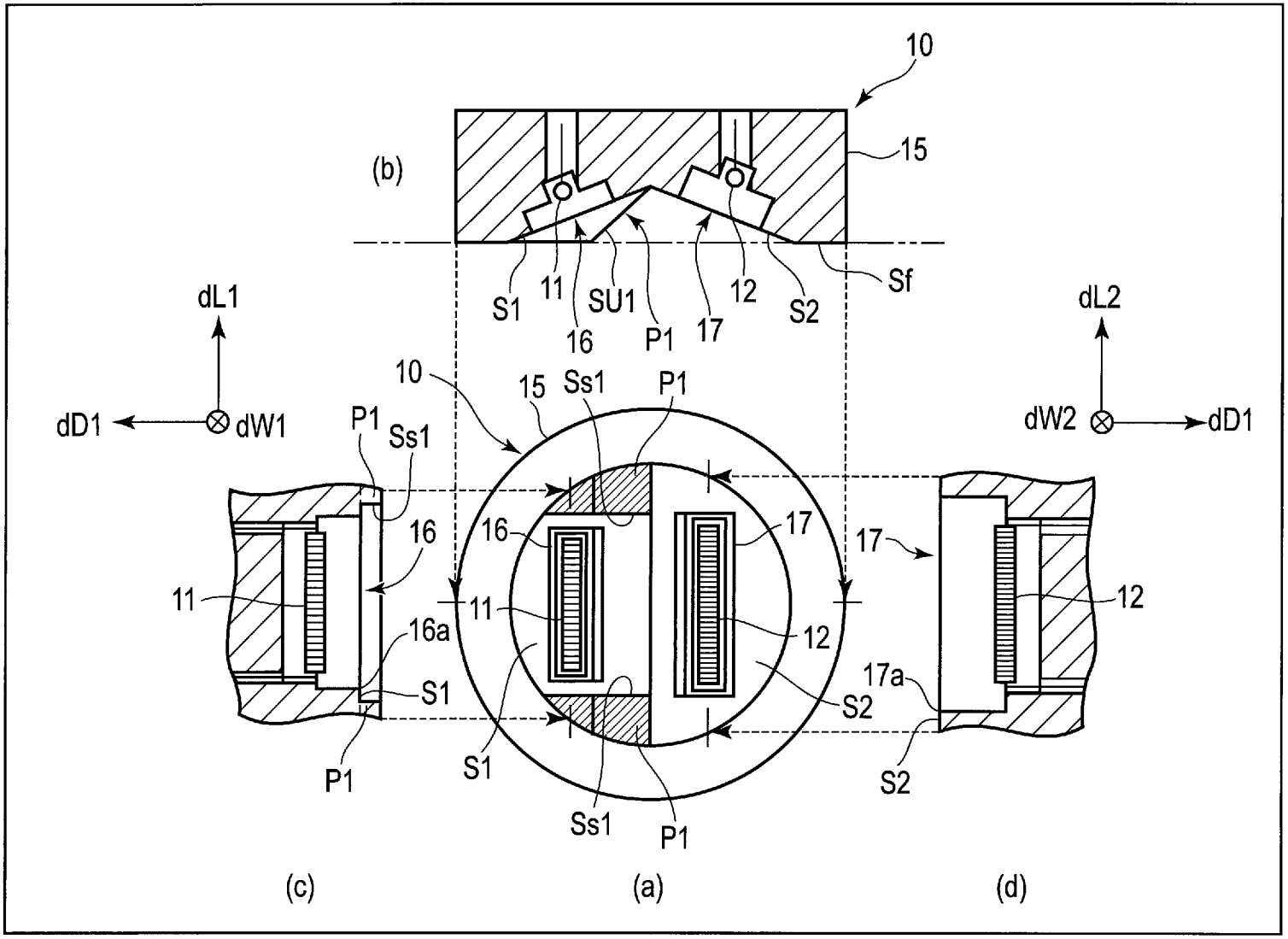
FIG. 2 is an enlarged view showing a cathode of an example of the embodiment, including (a) a plan view, (b) a cross-sectional view, (c) another cross-sectional view, and (d) another cross-sectional view.

As shown in FIG. 1 and FIG. 2, the cathode 10 includes one or more filament coils and an electron convergence cup 15 serving as a converging electrode. In the embodiment, the cathode 10 includes a first filament coil 11 serving as a first filament, and a second filament coil 12 serving as a second filament. The first filament coil 11 and the second filament coil 12 are formed of a material containing tungsten as its main component. The first filament coil 11 and the second filament coil 12 are formed to extend linearly. The first filament coil 11, the second filament coil 12, and the electron convergence cup 15 are electrically connected to terminals 81, 82, 83, 84, and 85.

The electron convergence cup 15 includes one or more trench portions in which the filament coil or coils (electron emission sources) are set. In this embodiment, the electron convergence cup 15 includes a first trench portion 16 in which the first filament coil 11 is set, and a second trench portion 17 in which the second filament coil 12 is set. The first filament coil 11 is accommodated in the first trench portion 16 and is located to be spaced apart from inner surfaces (side and bottom surfaces) of the first trench portion 16. The first filament coil 11 is supplied with a current (filament current). The first filament coil 11 thereby emits electrons (thermoelectrons). The second filament coil 12 is accommodated in the second trench portion 17 and is located to be spaced apart from inner surfaces (side and bottom surfaces) of the second trench portion 17. The second filament coil 12 is supplied with a current (filament current). The second filament coil 12 thereby emits electrons (thermoelectrons).

The first trench portion 16 and the second trench portion 17 are inclined such that the electrons emitted from the first filament coil 11 and the electrons emitted from the second filament coil 12 collide at substantially the same position on the target surface 62S. In addition, each of the first trench portion 16 and the second trench portion 17 includes a lower trench and an upper trench which is located on the target surface 62S side from the lower trench and has dimensions larger than those of the lower trench.

A relatively positive voltage is applied to the anode target 60 from the terminal 91 via the fixed shaft 40, the rotor 30, and the like. A relatively negative voltage is applied to the first filament coil 11, the second filament coil 12, and the electron convergence cup 15 from the terminals 81 to 83. In the embodiment, the X-ray tube 1 is an anode grounding type X-ray tube, the anode target 60 is set to a ground potential, and a negative high voltage is applied to the cathode 10.

Unlike the embodiment, however, the X-ray tube 1 may be a neutral grounding type X-ray tube or a cathode grounding type X-ray tube. In the neutral grounding type X-ray tube, a positively high voltage is applied to the anode target 60 and a negatively high voltage is applied to the cathode 10. In the cathode grounding type X-ray tube, a positively high voltage is applied to the anode target 60, and the cathode 10 is set to a ground potential.

Since an X-ray tube voltage (hereinafter referred to as a tube voltage) is applied between the anode target 60 and the cathode 10, the electrons emitted from the first filament coil 11 are accelerated and made incident on the target surface 62S as an electron beam. Similarly, electrons emitted from the second filament coil 12 are accelerated and made incident on the target surface 62S as an electron beam. The electron convergence cup 15 urges the electron beam traveling from the first filament coil 11 toward the anode target 60 through an opening 16*a* of the first trench portion 16 to be converged on one hand, and urges the electron beam traveling from the second filament coil 12 toward the anode target 60 through an opening 17*a* of the second trench portion 17 to be converged on the other hand.

As shown in FIG. 1, the vacuum envelope 70 is formed in a cylindrical shape. The vacuum envelope 70 is formed of a combination of insulating materials such as glass and ceramics, metals and the like. In the vacuum envelope 70, a diameter of a portion opposed to the anode target 60 is larger than a diameter of a portion opposed to the rotor 30. The vacuum envelope 70 includes an opening 71. The opening 71 is tightly attached to one end of the fixed shaft 40 in order to maintain the sealed state of the vacuum envelope 70. The vacuum envelope 70 fixes the fixed shaft 40. In the vacuum envelope 70, the cathode 10 is mounted on an inner wall. The vacuum envelope 70 is sealed, and accommodates the cathode 10, the sliding bearing unit 20, the anode target 60, and the like. The inside of the vacuum envelope 70 is maintained in a vacuum state. The stator coil 2 is provided to be opposed to the side surface of the rotor 30 and to surround the outside of the vacuum envelope 70. The stator coil 2 has an annular shape. The stator coil 2 is electrically connected to the terminals 92 and 93 and is driven via the terminals 92 and 93.

The housing 3 includes an X-ray transmission window 3*a* which transmits X-rays, at a position close to the target layer 62 opposed to the cathode 10. The housing 3 accommodates the X-ray tube 1 and the stator coil 2, and is filled with the insulating oil 4.

The control unit 5 is electrically connected to the cathode 10 via the terminals 81, 82, 83, 84, and 85. The control unit 5 can drive and control the first filament coil 11, the second filament coil 12, and the electron convergence cup 15. The control unit 5 selectively drives the first filament coil 11 and the second filament coil 12.

Next, an operation of the X-ray tube assembly for emitting X-rays will be described. As shown in FIG. 1, when the X-ray tube assembly is in operation, first, the stator coil 2 is driven via the terminals 92 and 93 to generate a magnetic field. That is, the stator coil 2 produces a rotating torque to be applied to the rotor 30. For this reason, the rotor rotates and the anode target 60 also rotates.

Next, the control unit 5 supplies a current to drive the first filament coil 11 or the second filament coil 12 via the terminals 81 to 85. Then, a negative high voltage (common voltage) is applied to the first filament coil 11 (second filament coil 12) and the electron convergence cup 15. The negative high voltage is, for example, in a range of negative tens of kilovolts (kV) to approximately −150 kV. A current is further supplied to the first filament coil 11 (second filament coil 12). A bias voltage (superimposed voltage based on the filament voltage) in a range of −5kV to 0V is applied to the electron convergence cup 15. The anode target 60 is grounded via the terminal 91.

Since the tube voltage is applied between the cathode 10 and the anode target 60, the electrons emitted from the filament coil are converged and accelerated and collide with the target layer 62. That is, an X-ray tube current (hereinafter referred to as a tube current) flows from the cathode 10 to a focal spot on the target surface 62S.

The electron beam is made incident on the target layer 62, which thereby emits X-rays, and the X-rays emitted from the focal spot are emitted to the outside of the housing 3 through the X-ray transmission window 3*a*. The electron beam is made incident on the focal spot, and the focal spot thereby has a length corresponding to the longer axis of the filament coil and a width corresponding to the shorter axis of the filament coil. X-ray imaging can be thereby performed.

Next, the structure and operation of the X-ray tube assembly according to the example of the embodiment and the structure and operation of an X-ray tube assembly of a comparative example will be described. The X-ray tube assemblies of the example and comparative example are manufactured similarly except for the electron convergence cup 15.

EXAMPLE

As shown in FIG. 1 and FIG. 2, the electron convergence cup 15 comprises a front surface Sf, a first surface S1, the first trench portion 16, a pair of first protrusions P1, a second surface S2, and the second trench portion 17. In FIG. 2(*a*), hatch lines are drawn on the first protrusions P1. The front surface Sf is a flat surface and is the surface closest to the anode target 60 of the electron convergence cup 15. Each of the first surface S1 and the second surface S2 is a flat surface located on the side opposite to the anode target 60 with respect to the front surface Sf.

The first trench portion 16 opens to the first surface S1 and accommodates the first filament coil 11. The first trench portion 16 has a first length direction dL1 along a longer axis of the first filament coil 11, a first depth direction dD1, and a first width direction dW1 perpendicular to the first depth direction dD1 and the first length direction dL1.

The second trench portion 17 opens to the second surface S2 and accommodates the second filament coil 12. The second trench portion 17 has a second length direction dL2 along a longer axis of the second filament coil 12, a second depth direction dD2, and a second width direction dW2 perpendicular to the second depth direction dD2 and the second length direction dL2.

A pair of first protruding portions P1 is formed to protrude from the first surface S1 toward the front surface Sf side and are provided to sandwich the first trench portion 16 in the first length direction dL1. The first protruding portions P1 do not protrude toward the anode target 60 side beyond the front surface Sf. The pair of first protruding portions P1 has first side surfaces Ss1 opposed to each other in the first length direction dL1. In the example, the first side surfaces Ss1 are surfaces which are flat and parallel to a first virtual plane defined by the first depth direction dD1 and the first width direction dW1. The first side surfaces Ss1 of the respective pair of first protruding portions P1 have the same dimensions. However, the configuration of the pair of first protruding portions P1 is not limited to the example but can be variously modified. For example, the first side surfaces Ss1 may not be surfaces parallel to the first virtual plane or may not be flat surfaces.

Each of the first protruding portions P1 has an upper surface SU1 on the side opposed to the anode target 60. The upper surface SU1 is formed of a plurality of flat inclined surfaces that are inclined in directions different from one another. In the example, the upper surface SU1 is formed of two flat inclined surfaces.

Comparative Example

Figure 11:
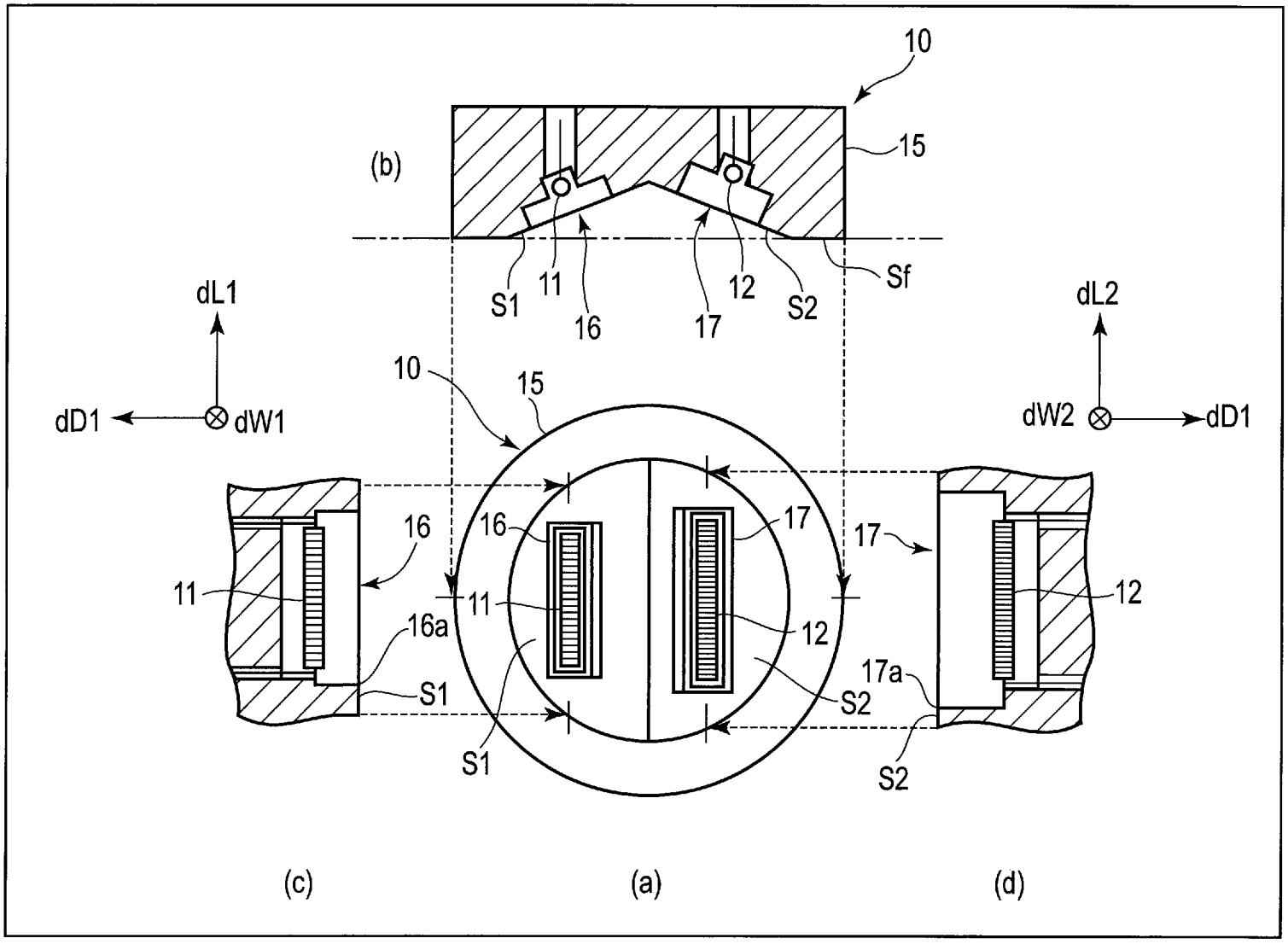
FIG. 11 is an enlarged view showing a cathode of a comparative example, including (a) a plan view, (b) a cross-sectional view, (c) another cross-sectional view, and (d) another cross-sectional view.

As shown in FIG. 1 and FIG. 11, the X-ray tube assembly of a comparative example is different from the X-ray tube assembly of the above example with respect to the configuration of the electron convergence cup 15. More specifically, the electron convergence cup 15 of the comparative example is different from the above example with respective of features that the electron convergence cup is formed without a pair of protruding portions P1, the first trench portion 16 (upper trench of the first trench portion 16) is formed to be deep, and the first trench portion 16 and the first filament coil 11 are formed to be short in the first length direction dL1.

The present inventors conducted simulation of emitting the X-rays by using the X-ray tube assembly according to the example and simulation of emitting the X-rays by using the X-ray tube assembly according to the comparative example. At this time, the simulations were conducted by adjusting the bias voltage applied to the electron convergence cup 15. A focal spot formed on the target surface 62S was a single focal spot. The simulations were conducted under the same conditions.

First, the procedure and results of the simulation of emitting the X-rays by using the X-ray tube assembly according to the example will be described.

Figure 3:
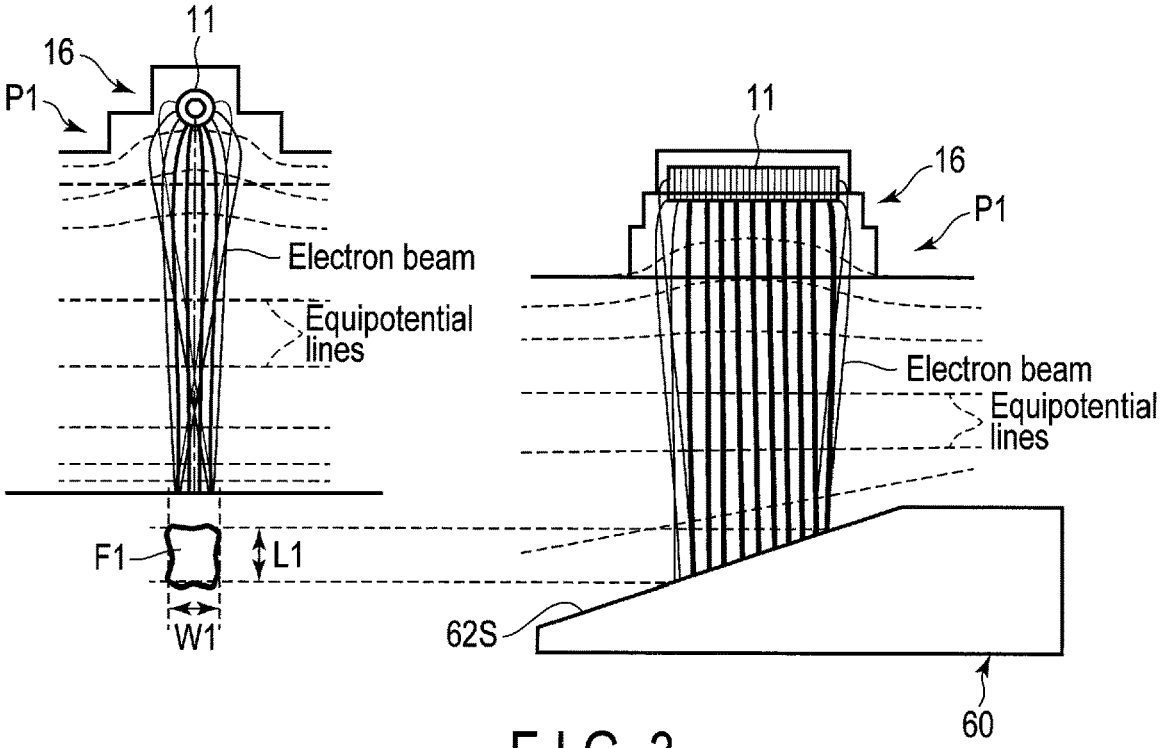
FIG. 3 is a schematic view showing the cathode and an anode target of the example as viewed in two directions perpendicular to a tube axis of the X-ray tube, and also showing a state in which an electron beam is emitted from a first filament coil toward the anode target in a case where a bias voltage to be applied to an electron convergence cup is set to 0V similarly to a filament voltage.

As shown in FIG. 1, FIG. 2, and FIG. 3, first, the X-ray tube assembly of the above example was used to commonly apply a negative high voltage to the first filament coil 11 and the electron convergence cup 15, to set the bias voltage applied to the electron convergence cup 15 to 0V, and to form the focal spot (large focal spot) F1 on the target surface 62S. Electrons were emitted from the whole region of the first filament coil 11 toward the target surface 62S. The electron beam was converged by the effect of the electric field formed by the first trench portion 16 of the electron convergence cup 15 and the first protrusion P1. In the formed focal spot (effective focal spot) F1, the length is referred to as L1 and the width is referred to as W2.

Figure 4:
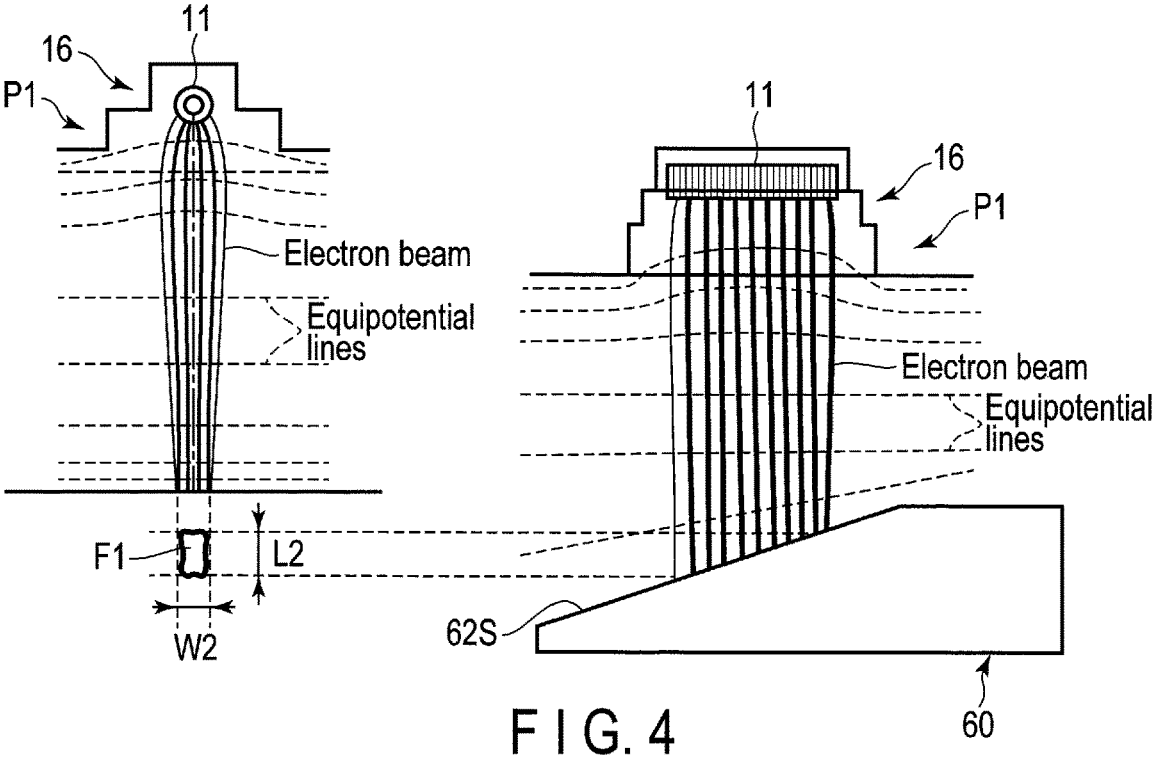
FIG. 4 is a schematic view showing the cathode and the anode target of the example as viewed in two directions perpendicular to the tube axis of the X-ray tube, and also showing a state in which an electron beam is emitted from a filament coil toward the anode target in a case where a bias voltage which is negative to the filament voltage is applied to an electron convergence cup.

As shown in FIG. 1, FIG. 2, and FIG. 4, next, the X-ray tube assembly of the above example was used to commonly apply a negative high voltage to the first filament coil 11 and the electron convergence cup 15, to further apply a bias voltage which is negative to the filament voltage to the electron convergence cup 15, and to form the focal spot (small focal spot) F1 on the target surface 62S. Electrons were emitted from a central portion of the first filament coil 11 toward the target surface 62S. Due to the effect of the first protruding portion P1, the end portion of the first filament coil 11 was larger than the central portion of the first filament coil 11 with respect to the effect of the electric field. The quantity of the electrons from the end portion of the first filament coil 11 was not decreased. The electron beam was converged by the effect of the electric field formed by the first trench portion 16 of the electron convergence cup 15 and the first protrusion P1.

The width of the formed focal spot (effective focal spot) F1 was W2. In addition, since the quantity of the electrons emitted from the end portion of the first filament coil 11 was not decreased as described above, the length of the focal spot (effective focal spot) F1 was L2, i.e., slightly smaller than the above length L1. W2 was smaller than W1, and L2 was smaller than L1. It can be understood from comparison between the focal spot (large focal spot) F1 in FIG. 3 and the focal spot (small focal spot) F1 in FIG. 4 that the variation in length is smaller than the variation in width.

Figure 5:
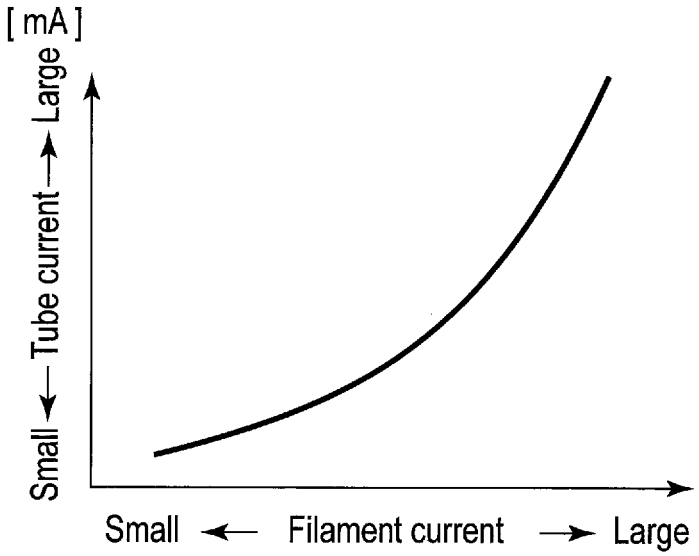
FIG. 5 is a graph showing a variation in a tube current to a filament current supplied to the first filament coil in a case where the bias voltage of the example is set to 0V.
Figure 6:
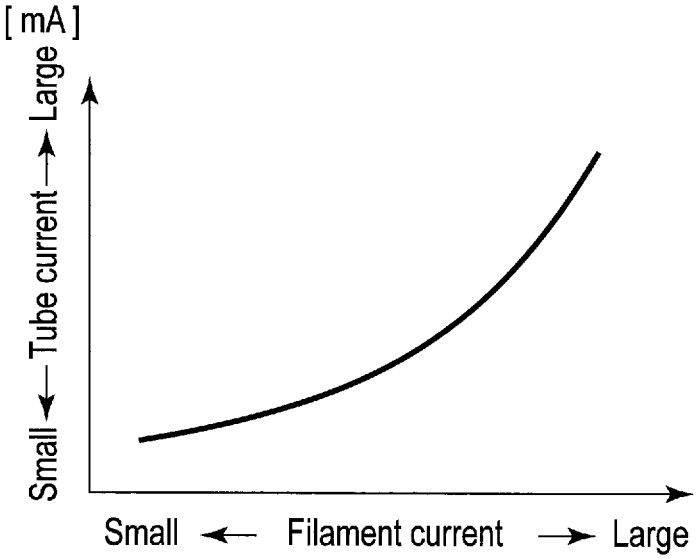
FIG. 6 is a graph showing a variation in a tube current to a filament current supplied to the first filament coil in a case where a negative bias voltage is applied to the electron convergence cup of the example.

In addition, as shown in FIG. 5 and FIG. 6, the filament current to be supplied to the first filament coil 11 was varied continuously and the tube current was measured. It can be understood that in the example, even though the bias voltage is 0V or −5 kV the tube current can be made larger as the filament current becomes larger.

Figure 7:
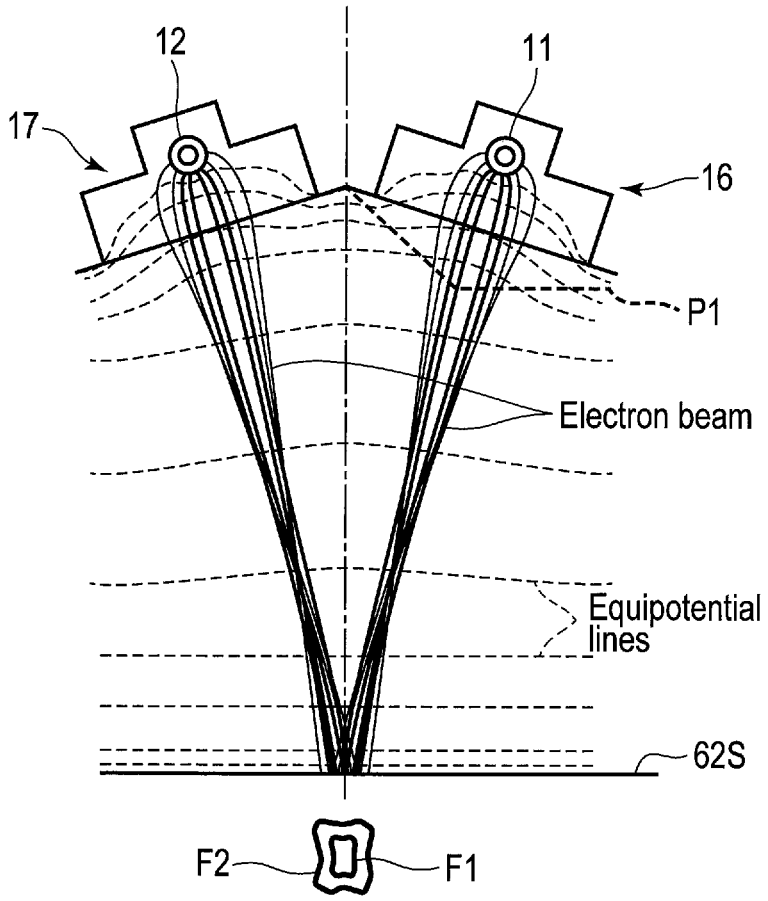
FIG. 7 is a view illustrating an orbit of an electron beam emitted from the first filament coil toward the anode target to form a first focal spot and an orbit of an electron beam emitted from a second filament coil toward the anode target to form a second focal spot, in the example, and also illustrating a state in which the first focal spot and the second focal spot overlap. However, emitting electrons from the first filament coil and the second filament coil at the same time is not intended.

Then, it can be understood that as shown in FIG. 7, the focal point F1 formed by the electrons emitted from the first filament coil 11 and the focal point F2 formed by the electrons emitted from the second filament coil 12 can be formed at substantially the same positions. For this reason, it can be understood that the first protruding portion P1 does not affect superposition of the focal point F1 and the focal point F2.

Next, the procedure and results of the simulation of emitting the X-rays by using the X-ray tube assembly according to the comparative example will be described.

Figure 12:
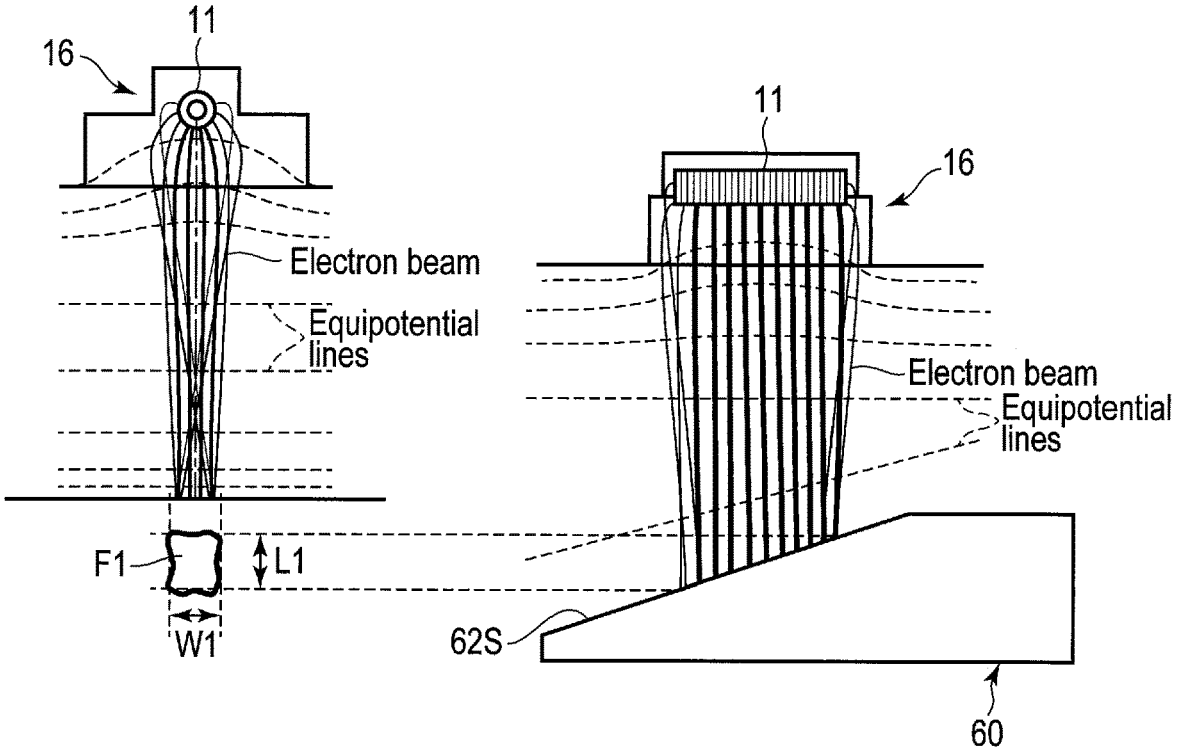
FIG. 12 is a schematic view showing the cathode and an anode target of the comparative example as viewed in two directions perpendicular to a tube axis of the X-ray tube, and also showing a state in which an electron beam is emitted from a first filament coil toward the anode target in a case where a bias voltage to be applied to an electron convergence cup is set to 0V, i.e., the electron convergence cup and the filament are set at the same electric potential.

As shown in FIG. 1, FIG. 11, and FIG. 12, first, the X-ray tube assembly of the above comparative example was used to commonly apply a negative high voltage to the first filament coil 11 and the electron convergence cup 15, to set the bias voltage applied to the electron convergence cup 15 to 0V, and to form the focal spot (large focal spot) F1 on the target surface 62S. The focal spot (effective focal spot) F1 of the comparative example was formed in the same dimensions as the example, and its length is referred to as L1 and its width is referred to as W1. However, since the first filament coil 11 in the comparative example is shorter than that in the example, the electron density of the focal point F1 becomes lower and the tube current becomes smaller.

Figure 13:
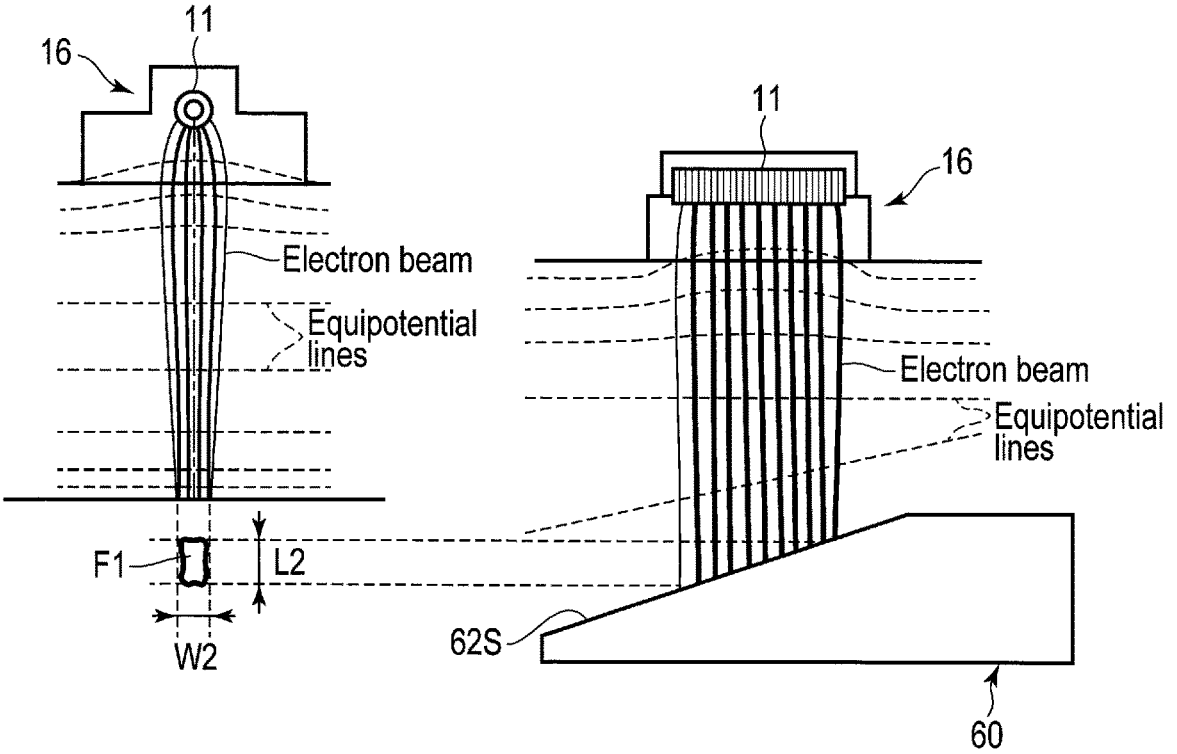
FIG. 13 is a schematic view showing the cathode and the anode target of the comparative example as viewed in two directions perpendicular to the tube axis of the X-ray tube, and also showing a state in which an electron beam is emitted from a filament coil toward the anode target in a case where a bias voltage which is negative to the filament voltage is applied to an electron convergence cup.

As shown in FIG. 1, FIG. 11, and FIG. 13, next, the X-ray tube assembly of the above comparative example was used to commonly apply a negative high voltage to the first filament coil 11 and the electron convergence cup 15, to further apply a negative bias voltage to the electron convergence cup 15, and to form the focal spot (small focal spot) F1 on the target surface 62S. Electrons were emitted from a central portion of the first filament coil 11 toward the target surface 62S. The quantity of the electrons from the end portion of the first filament coil 11 was not decreased.

The width of the formed focal spot (effective focal spot) F1 was W2. In addition, since the quantity of the electrons emitted from the end portion of the first filament coil 11 was not decreased as described above, the focal spot (effective focal spot) F1 of the comparative example was formed in the same dimensions as the example, and its length was L2 and its width was W2. As described above, however, since the first filament coil 11 in the comparative example is shorter than that in the example, the electron density of the focal spot F1 becomes lower and the tube current becomes smaller.

Figure 14:
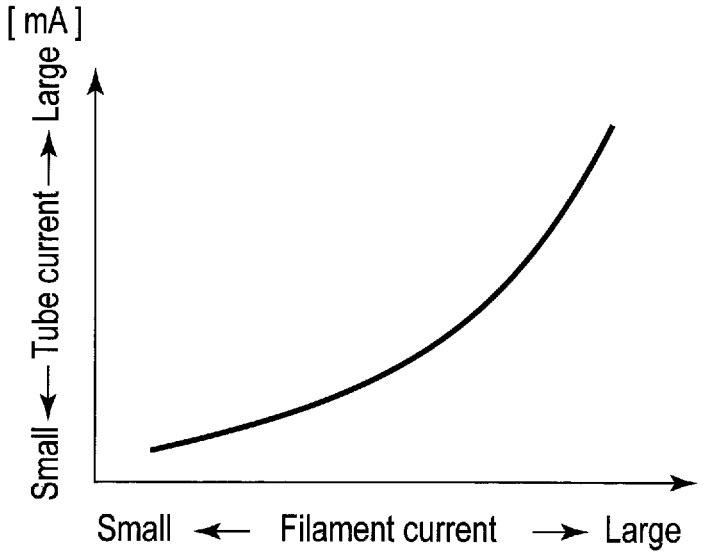
FIG. 14 is a graph showing a variation in a tube current to a filament current supplied to the first filament coil in a case where the bias voltage of the comparative example is set to 0V.
Figure 15:
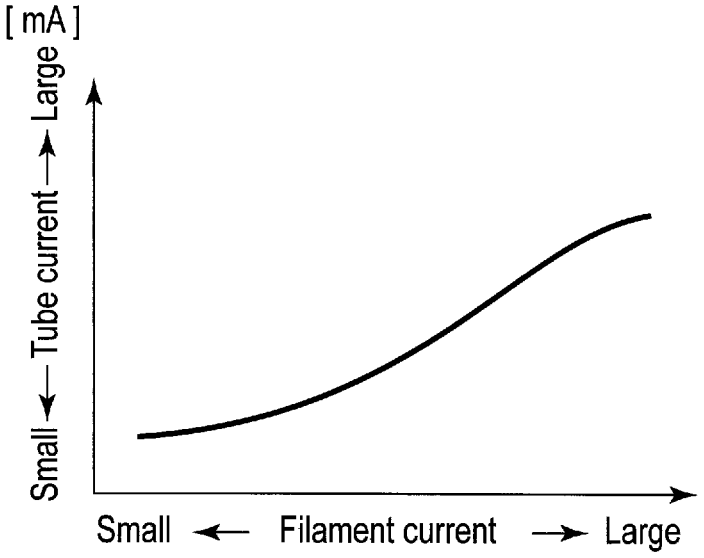
FIG. 15 is a graph showing a variation in a tube current to a filament current supplied to the first filament coil in a case where a negative bias voltage is applied to the electron convergence cup of the comparative example.

In addition, as shown in FIG. 14 and FIG. 15, the filament current to be supplied to the first filament coil 11 was varied continuously and the tube current was measured. It can be understood that in the modified example, if the bias voltage is 0V the tube current can be made larger as the filament current becomes larger. It can be understood that when the bias voltage is set to several hundreds of V, for example, −1kv the tube current can hardly be made larger even if the filament current is made larger as shown in FIG. 15.

Figure 16:
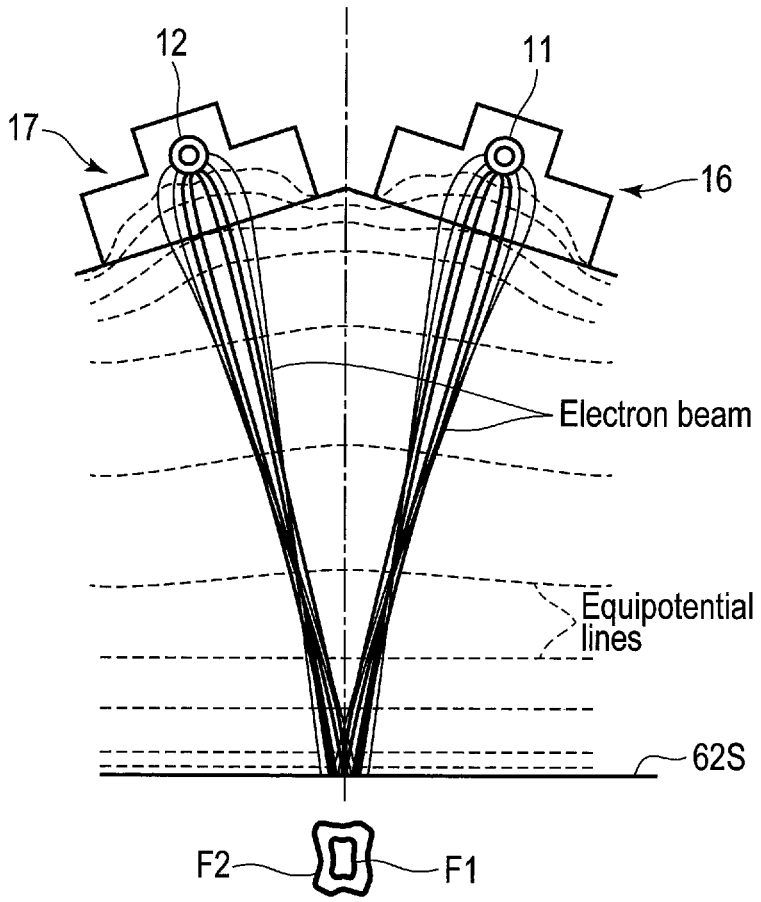
FIG. 16 is a view illustrating an orbit of an electron beam emitted from the first filament coil toward the anode target to form a first focal spot and an orbit of an electron beam emitted from a second filament coil toward the anode target to form a second focal spot, in the comparative example, and also illustrating a state in which the first focal spot and the second focal spot overlap. However, emitting electrons from the first filament coil and the second filament coil at the same time is not intended.

Then, it can be understood that in the comparative example, as shown in FIG. 16, the focal spot F1 formed by the electrons emitted from the first filament coil 11 and the focal spot F2 formed by the electrons emitted from the second filament coil 12 can be formed at substantially the same positions similarly to the example (FIG. 7).

According to the X-ray tube assembly of the example of the embodiment having the above-described structure, the X-ray tube 1 comprises the anode target 60, the cathode 10 including the first filament coil 11 and the electron convergence cup 15, and the vacuum envelope 70. The electron convergence cup 15 comprises a front surface Sf, the first surface S1, the first trench portion 16, and a pair of first protruding portions P1. A pair of first protruding portions P1 is formed to protrude from the first surface S1 toward the front surface Sf side and sandwich the first trench portion 16 in the first length direction dL1.

For this reason, it can be understood that even if the long first filament coil 11 is used the tube current can be made larger while setting the length of the focal point F1 to a desired value. Alternatively, even if the first trench portion 16 is made shallow the tube current can be made larger while setting the dimensions of the focal point F1 to desired values.

Based on the above, the X-ray tube 1 capable of performing the focal spot dimension variation control and the tube current control easily and stably, and suppressing enlargement of the electron convergence cup 15, and the X-ray tube assembly comprising the X-ray tube 1 can be obtained.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, the upper surface SU1 of the first protruding portion P1 can be formed of three or more flat inclined surfaces.

Figure 8:
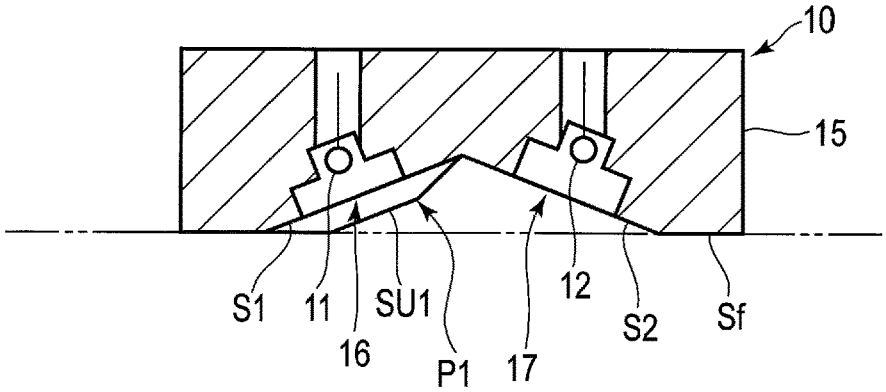
FIG. 8 is a cross-sectional view showing a first modified example of the cathode of the X-ray tube assembly according to the example.

As shown in FIG. 8, the upper surface SU1 of the first protruding portion P1 is formed of three flat inclined surfaces.

Figure 9:
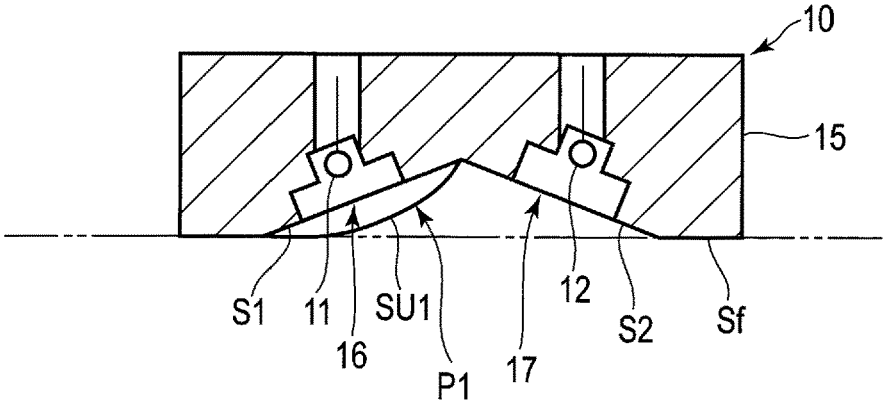
FIG. 9 is a cross-sectional view showing a second modified example of the cathode of the X-ray tube assembly according to the example.

As shown in FIG. 9, the upper surface SU1 of the first protruding portion P1 may be formed of an arcuately curved surface.

Figure 10:
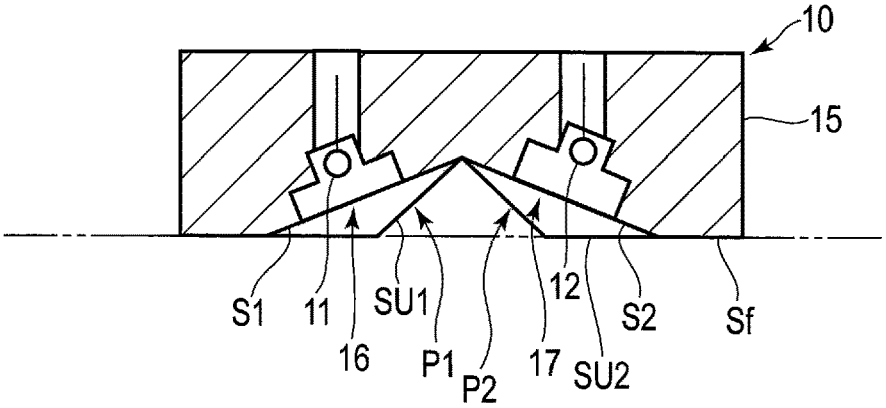
FIG. 10 is a cross-sectional view showing a third modified example of the cathode of the X-ray tube assembly according to the example.

As shown in FIG. 10, the electron convergence cup 15 may further comprise a pair of second protruding portions P2. A pair of second protruding portions P2 is formed to protrude from the second surface S2 toward the front surface Sf side and sandwich the second trench portion 17 in the second length direction dL2. The second protruding portion P2 comprises an upper surface SU2 on the side opposed to the anode target 60, and is formed similarly to the first protruding portion P1.

In the above embodiment, the first filament coil 11 is shorter than the second filament coil 12. However, when the cathode 10 comprises a plurality of filament coils, the plurality of filament coils may be of the same type or different types. A plurality of focal spots of different dimensions can be selected by making the types different. When the filament coils are of the same type, the lifetimes of the filaments can be extended by alternately using the filaments.

If the electron convergence cup 15 comprises a plurality of trench portions, at least one trench portion may be formed in a set with the protruding portion similarly to the trench portion of the above example, and the other trench portions may be formed without using the protruding portions.

The filaments serving as electron emission sources are not limited to the filament coils but various types of filaments can be used. For example, the cathode 10 may comprise flat filaments instead of the filament coils. In this case, too, the same advantages as those of the above embodiment can be obtained. The flat filament is a flat plate-like filament having a flat upper surface of filament (electron emission surface) as a plane and a back surface.

The X-ray tube and the X-ray tube assembly of the present invention are not limited to the above X-ray tube and X-ray tube assembly but can be variously modified, and can be applied to various types of X-ray tubes and X-ray tube assemblies. For example, the X-ray tube of the present invention can also be applied to a stationary anode type X-ray tube assembly.

What is claimed is:

1. An X-ray tube comprising:

an anode target emitting X-rays by electrons made incident thereon;

a cathode comprising a first filament emitting electrons and a converging electrode urging the electrons emitted from the first filament to be converged; and a vacuum envelope accommodating the anode target and the cathode, wherein the converging electrode comprises:

a flat front surface which is the closest to the anode target;

a flat first surface located on a side opposite to the anode target with respect to the front surface;

a first trench portion opening to the first surface, accommodating the first filament, and having a first length direction along a longer axis of the first filament; and a pair of first protruding portions formed to protrude from the first surface toward the front surface side and sandwiching the first trench portion in the first length direction, and an upper surface of each of the first protruding portions on a side opposed to the anode target is formed of a plurality of flat inclined surfaces inclined in directions different from one another.

2. The X-ray tube of claim 1, wherein the pair of first protruding portions ham has first side surfaces opposed to each other in the first length direction.

3. The X-ray tube of claim 2, wherein the first trench portion has a first width direction perpendicular to each of the first depth direction and the first length direction of the first trench portion, and each of the first side surfaces is parallel to a first virtual plane defined by the first depth direction and the first width direction.

4. The X-ray tube of claim 2, wherein the first side surfaces of the pair of first protruding portions have same dimensions.

5. An X-ray tube comprising:

an anode target emitting X-rays by electrons made incident thereon;

a cathode comprising a first filament emitting electrons and a converging electrode urging the electrons emitted from the first filament to be converged; and a vacuum envelope accommodating the anode target and the cathode, wherein the converging electrode comprises:

a flat front surface which is the closest to the anode target;

a flat first surface located on a side opposite to the anode target with respect to the front surface;

a first trench portion opening to the first surface, accommodating the first filament, and having a first length direction along a longer axis of the first filament; and a pair of first protruding portions formed to protrude from the first surface toward the front surface side and sandwiching the first trench portion in the first length direction, and an upper surface of each of the first protruding portions on a side opposed to the anode target is formed of an arcuate curved surface.

6. An X-ray tube comprising:

an anode target emitting X-rays by electrons made incident thereon;

a cathode comprising a first filament emitting electrons, a second filament emitting electrons, and a converging electrode urging the electrons emitted from the first filament and the electrons emitted from the second filament to be converged; and a vacuum envelope accommodating the anode target and the cathode, wherein the converging electrode comprises:

a flat front surface which is the closest to the anode target;

a flat first surface located on a side opposite to the anode target with respect to the front surface;

a first trench portion opening to the first surface, accommodating the first filament, and having a first length direction along a longer axis of the first filament;

a pair of first protruding portions formed to protrude from the first surface toward the front surface side and sandwiching the first trench portion in the first length direction;

a flat second surface located on a side opposite to the anode target with respect to the front surface; and a second trench portion opening to the second surface, accommodating the second filament, and having a second length direction along a longer axis of the second filament, the first surface and the second surface are inclined toward the front surface and are opposed to each other, and an upper surface of each of the first protruding portions on a side opposed to the anode target is formed of a plurality of flat inclined surfaces inclined in directions different from one another.

7. The X-ray tube of claim 5, wherein the pair of first protruding portions has first side surfaces opposed to each other in the first length direction.

8. The X-ray tube of claim 1, wherein a surface of the protruding portions is joined to and extends from the front surface.

* * * * *